US011701570B2

(12) United States Patent
Porter

(10) Patent No.: US 11,701,570 B2
(45) Date of Patent: Jul. 18, 2023

(54) SNOW SPORT SHOCK ABSORBING DEVICE

(71) Applicant: Daniel Ray Porter, Graham, WA (US)

(72) Inventor: Daniel Ray Porter, Graham, WA (US)

( * ) Notice: Subject to any disclaimer, the term of this patent is extended or adjusted under 35 U.S.C. 154(b) by 0 days.

(21) Appl. No.: 17/473,344

(22) Filed: Sep. 13, 2021

(65) Prior Publication Data

US 2023/0084788 A1 Mar. 16, 2023

(51) Int. Cl.
*A63C 5/075* (2006.01)
*A63C 5/03* (2006.01)

(52) U.S. Cl.
CPC ..... *A63C 5/075* (2013.01); *A63C 5/03* (2013.01)

(58) Field of Classification Search
CPC ..... A63C 5/075; A63C 5/03
See application file for complete search history.

(56) References Cited

U.S. PATENT DOCUMENTS

| | | | | |
|---|---|---|---|---|
| 4,979,761 | A | 12/1990 | Rohlin | |
| 6,283,241 | B1 * | 9/2001 | Kubota | B62M 27/02 305/128 |
| 6,296,258 | B2 | 10/2001 | Higgins et al. | |
| 6,328,324 | B1 * | 12/2001 | Fenton | B60G 11/465 280/124.165 |
| 6,644,681 | B2 | 11/2003 | Couderc et al. | |
| 6,648,348 | B2 | 11/2003 | Link | |
| 7,137,638 | B2 * | 11/2006 | Turner | B62K 25/02 280/279 |
| 7,395,890 | B2 * | 7/2008 | Visscher | B62M 27/02 180/9.5 |
| 7,533,891 | B2 | 5/2009 | Orr et al. | |
| 9,908,029 | B2 * | 3/2018 | Linzmeier | A63C 9/003 |
| 9,981,178 | B1 * | 5/2018 | Huynh | A63C 5/03 |
| 11,013,980 | B2 * | 5/2021 | Nichols | A63C 9/003 |
| 2004/0100069 | A1 | 5/2004 | Cumby | |
| 2004/0227311 | A1 | 11/2004 | Sanders | |
| 2004/0232656 | A1 | 11/2004 | Gyr | |
| 2009/0039610 | A1 * | 2/2009 | Karpik | B62M 27/02 280/124.129 |

FOREIGN PATENT DOCUMENTS

| | | | | |
|---|---|---|---|---|
| DE | 10040775 | A1 * | 3/2002 | A63C 5/075 |
| DE | 10223151 | A1 * | 11/2003 | A63C 5/075 |
| EP | 3656450 | A1 * | 5/2020 | A63C 11/001 |
| WO | WO-0211829 | A2 * | 2/2002 | A63C 5/075 |

* cited by examiner

*Primary Examiner* — James A Shriver, II
*Assistant Examiner* — Michael T. Walsh
(74) *Attorney, Agent, or Firm* — Olav M. Underdal; IDP Patent Services

(57) ABSTRACT

A snow sport shock absorbing system includes: a snow sport device and a shock absorbing device, which is configured to attach to the snow sport device, such that the shock absorbing device absorbs shocks incurred from using the snow sport shock absorbing system for movement on a ground surface. The shock absorbing device includes an upper mounting structure, a lower mounting structure, and a shock absorber which is connected between the upper lower mounting structures.

17 Claims, 11 Drawing Sheets

SNOW SPORT SHOCK ABSORBING DEVICE

CROSS-REFERENCE TO RELATED APPLICATIONS

N/A.

FIELD OF THE INVENTION

The present invention relates generally to the field of snow sports, and more particularly to methods and systems for shock absorption for snow equipment.

BACKGROUND OF THE INVENTION

Snow sports such as snowboarding and skiing can often injure joints of those participating. The ongoing vibrations and big hits upon landings can take a toll on a user's joints, as the user's feet and legs absorb the majority of vibrations and shocks from riding down slopes and jumping. Additionally, the vibrations from icy or rutted ski slopes create less control on a ride, more discomfort, and muscle fatigue.

As such, considering the foregoing, it may be appreciated that there continues to be a need for novel and improved devices and methods for shock absorption for snow equipment.

SUMMARY OF THE INVENTION

The foregoing needs are met, to a great extent, by the present invention, wherein in aspects of this invention, enhancements are provided to the existing model of snow sport shock absorbing systems.

In an aspect, a snow sport shock absorbing system can include:

a) a snow sport device; and b) a shock absorbing device, which can be configured to attach to the snow sport device;

wherein the shock absorbing device can be configured to absorb shocks incurred from using the snow sport shock absorbing system for movement on a ground surface, whereby the snow sport shock absorbing system can provide a user with a smoother ride that is easier on joints of the user.

In a related aspect, the shock absorbing device can include:

a) a lower mounting structure, which can be configured to connect to the snow sport device, such that the lower mounting structure can be configured as a plate;

b) an upper mounting structure, which can be configured to compress downwards towards the lower mounting structure, such that the upper mounting structure can be configured as a plate; and c) a shock absorber, which can be connected between the lower mounting structure and the upper mounting structure, such that the shock absorber can absorb and damp shock impulses from a ground surface as the shock impulses travel from the lower mounting structure to the upper mounting structure.

In another related aspect, the shock absorbing device can include:

a) a plurality of linkage arm assemblies, which can be configured to connect the upper mounting structure and the lower mounting structure, such that the upper mounting structure can compress downwards towards the lower mounting structure.

In yet another related aspect, the shock absorbing device can further include a safety assembly, which can be configured to stop the plurality of linkage arm assemblies from decompressing upwards past a maximum height.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. In addition, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1A:
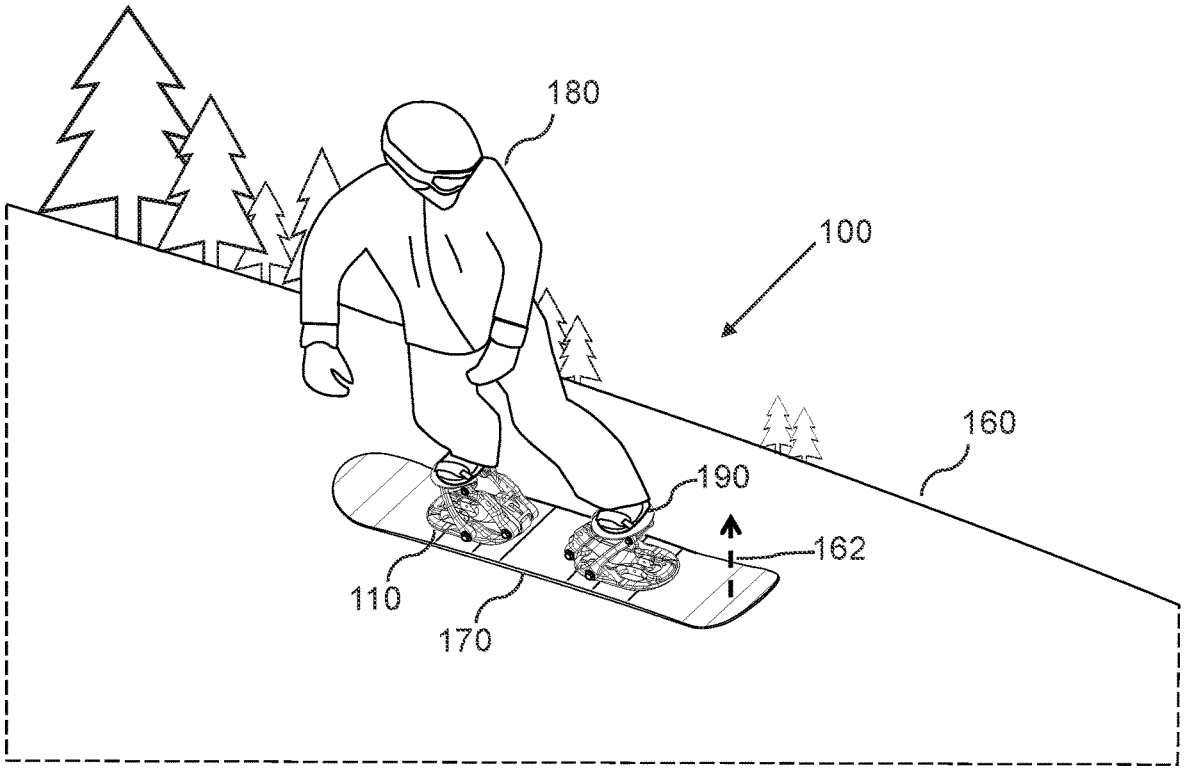
FIG. 1A is a perspective view illustrating the snow sport shock absorbing system in use, according to an embodiment of the invention.

Before describing the invention in detail, it should be observed that the present invention resides primarily in a novel and non-obvious combination of elements and process steps. So as not to obscure the disclosure with details that will readily be apparent to those skilled in the art, certain conventional elements and steps have been presented with lesser detail, while the drawings and specification describe in greater detail other elements and steps pertinent to understanding the invention.

The following embodiments are not intended to define limits as to the structure or method of the invention, but only to provide exemplary constructions. The embodiments are permissive rather than mandatory and illustrative rather than exhaustive.

In the following, we describe the structure of an embodiment of a snow sport shock absorbing system 100 with reference to FIG. 1, in such manner that like reference numerals refer to like components throughout; a convention that we shall employ for the remainder of this specification.

Figure 1B:
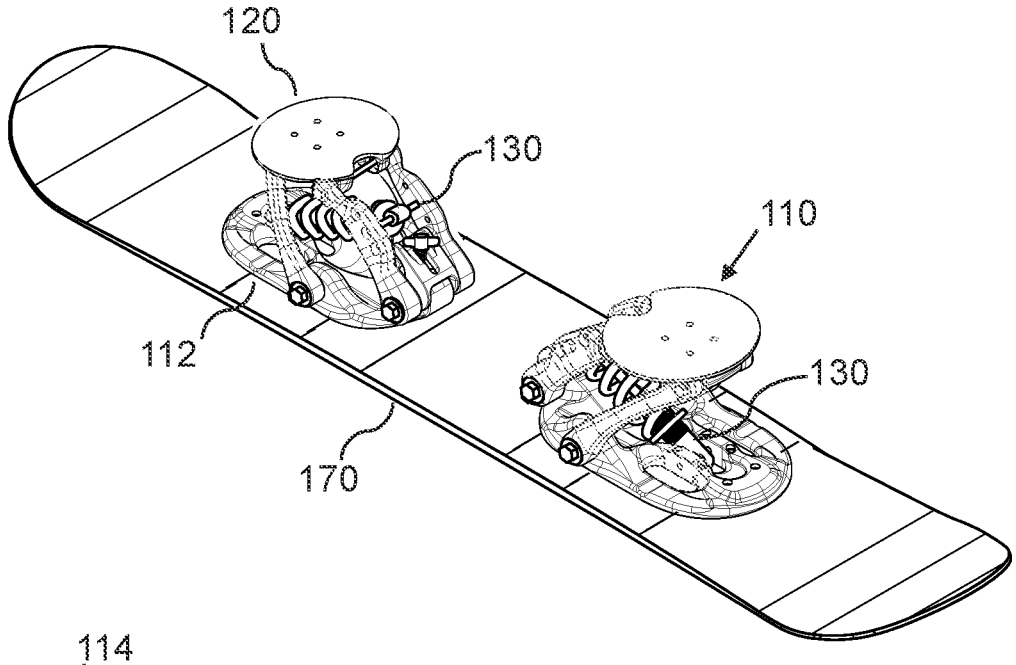
FIG. 1B is a perspective view of the shock absorbing device attached to a snow sport device, according to an embodiment of the invention.
Figure 1C:
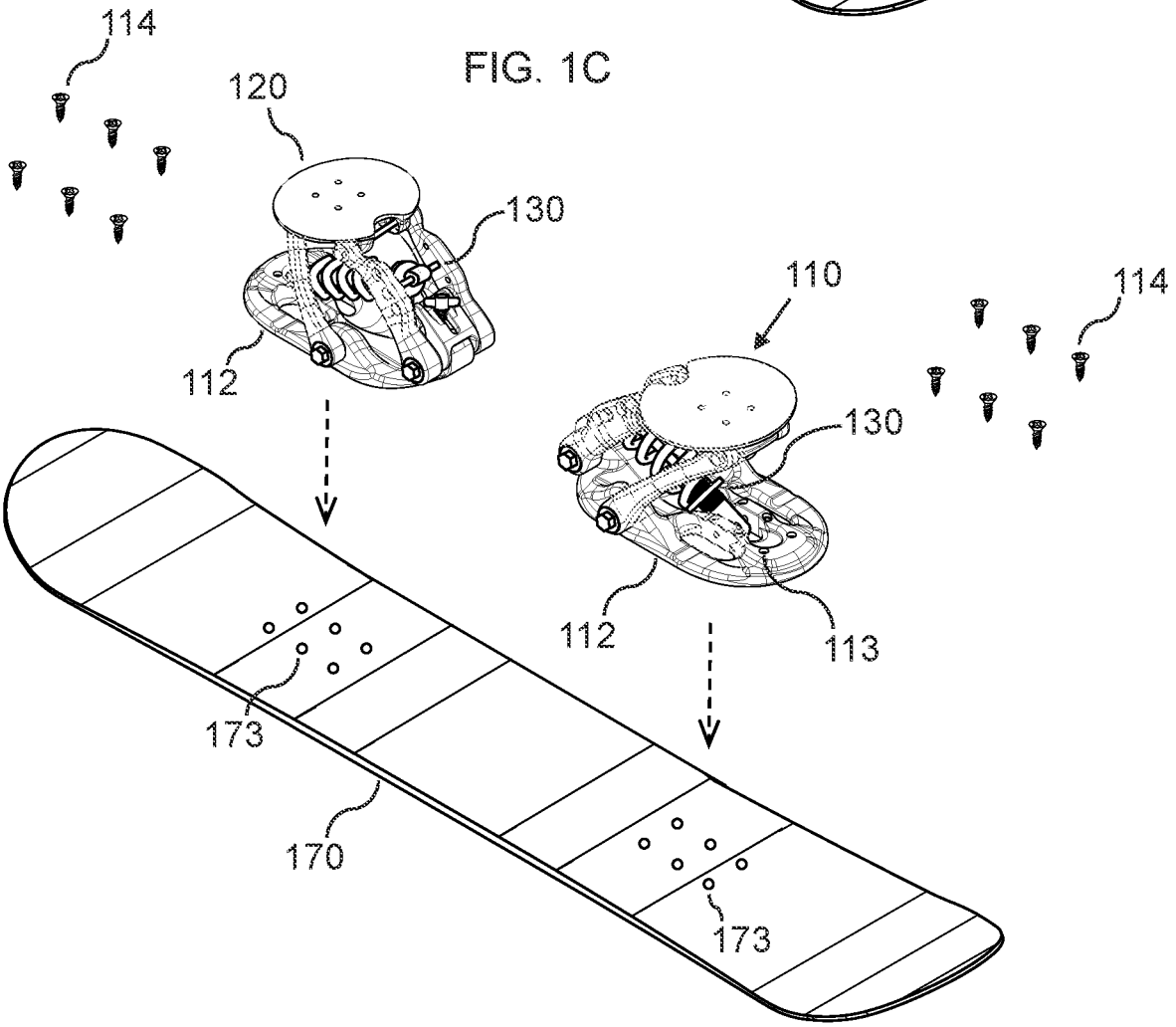
FIG. 1C is a perspective view illustrating the attachment of the shock absorbing device to a snow sport device, according to an embodiment of the invention.

In an embodiment, as shown in FIGS. 1A, 1B, and 1C, a snow sport shock absorbing system 100 can include:

a) a snow sport device 170; and b) at least one shock absorbing device 110, which can be configured to attach to the snow sport device 170;

wherein the shock absorbing device 110 can be configured to absorb shock impulses 162 incurred from using the snow sport shock absorbing system 100 for movement on a ground surface 160, whereby the snow sport shock absorbing system 100 can provide a user 180 with a smooth ride on the ground surface, such that the smooth ride is easier on joints of the user 180.

In a related embodiment, the snow sport device 170 can be configured as a snowboard, as shown in FIG. 1A, or a ski which is a part of a pair of skis, each mounted with at least one shock absorbing device 110, between the ski and a ski binding. Alternatively, the snow sport device 170 can be a snow mobile, such that shock absorbing devices 110 are mounted between skis and a body of the snow mobile. Further, the shock absorbing device 110 can be used as a shock absorbing system on other types of vehicles or machines.

In another related embodiment, as shown in FIGS. 1A, 1B, 2A and 2B, the shock absorbing device 110 can include:

a) a lower mounting structure 112, which can be configured to connect to the snow sport device 170, such that the lower mounting structure 112 can be configured as a plate;

b) an upper mounting structure 120, which can be configured to compress downwards towards the lower mounting structure 112, such that the upper mounting structure 120 can be configured as a plate; and c) a shock absorber 130, which can be connected between the lower mounting structure 112 and the upper mounting structure 120, such that the shock absorber 130 absorbs and damps shock impulses from a ground surface 160 as the shock impulses travel from the lower mounting structure 112 to the upper mounting structure 120.

In a related embodiment, as shown in FIGS. 1B and 1C, wherein the snow sport device 170 can further include a conventional set of attachment holes 173, and the lower mounting structure 112 can include attachment apertures 113, which can be configured to align with the attachment holes 173 of the snow sport device 170, such that a plurality of screws 114 can be inserted through the attachment apertures 113 into the attachment holes 173 and attach the lower mounting structure 112 to the snow sport device 170.

Figure 1D:
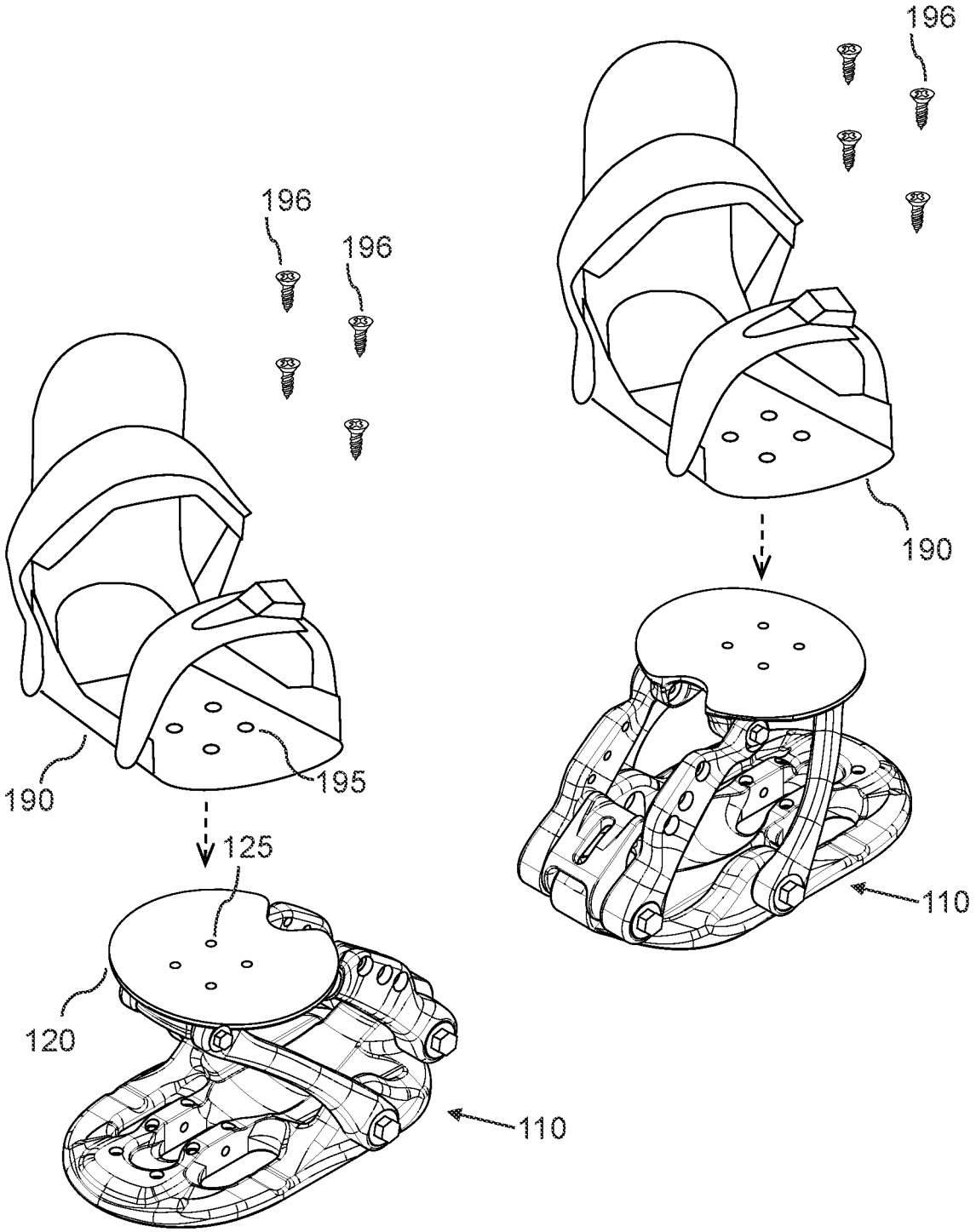
FIG. 1D is a perspective view illustrating the attachment of the snow equipment piece to the shock absorbing device, according to an embodiment of the invention.
Figure 1E:
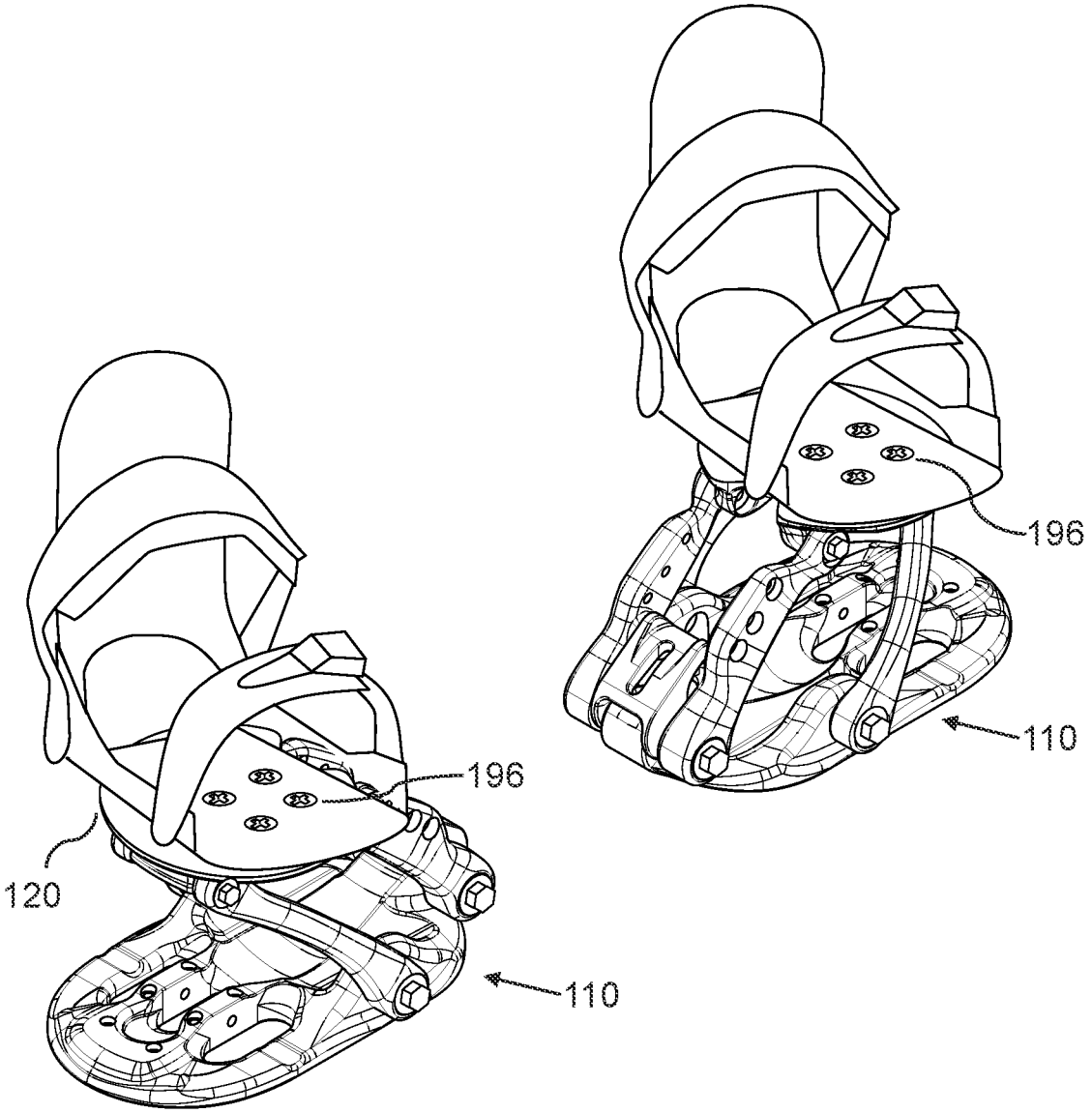
FIG. 1E is a perspective view illustrating the snow equipment piece attached to the shock absorbing device, according to an embodiment of the invention.

In a further related embodiment, as shown in FIG. 1D, the upper mounting structure 120 can include snow equipment piece attachment holes 125, which can be configured to align with a conventional set of snow equipment piece apertures 195 on a snow equipment piece 190, such that a plurality of screws 196 can be insertable through the snow equipment piece apertures 195 into the snow equipment piece attachment holes 125, such that the plurality of screws 196 can attach the snow equipment piece 190 to the upper mounting structure 120.

In yet another related embodiment, the snow equipment piece 190 can be a snowboard binding, as shown in FIG. 1D, or a ski binding.

Figure 2A:
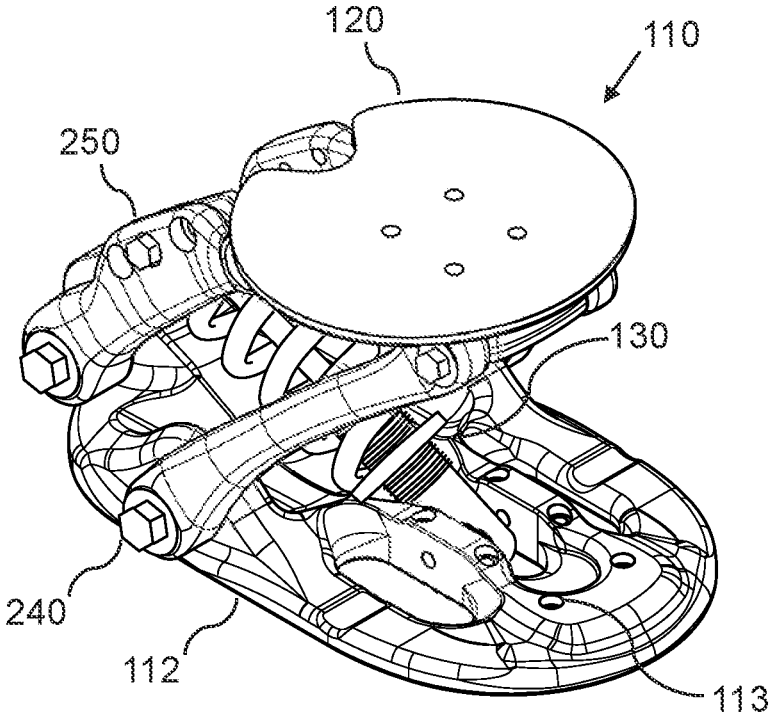
FIG. 2A is a front perspective view of the shock absorbing device, according to an embodiment of the invention.

In a related embodiment, as shown in FIG. 2A, the shock absorbing device 110 can include:

a) a plurality of linkage arm assemblies 240, 250, which can be configured to connect the upper mounting structure 120 and the lower mounting structure 112, such that the upper mounting structure 120 can be compressible downwards 502 towards the lower mounting structure 112.

In another related embodiment, as shown in FIGS. 3A, 3B, 5A and 5B, the plurality of linkage arm assemblies 240, 250 can include:

a) a front linkage arm assembly 240, which can include at least one front linkage arm 342, wherein an upper end of the at least one front linkage arm 342 can be rotatably 542 connected to a front end of the upper mounting structure 120 and a lower end of the at least one front linkage arm 342 can be rotatably 544 connected to the lower mounting structure 112; and b) a rear linkage arm assembly 250, which can include at least one rear linkage arm 352, wherein an upper end of the at least one rear linkage arm 352 can be rotatably 552 connected to a rear end of the upper mounting structure 120 and a lower end of the at least one rear linkage arm 352 is rotatably 554 connected to the lower mounting structure 112, to a rear of the lower end of the at least one front linkage arm 342.

Figure 4:
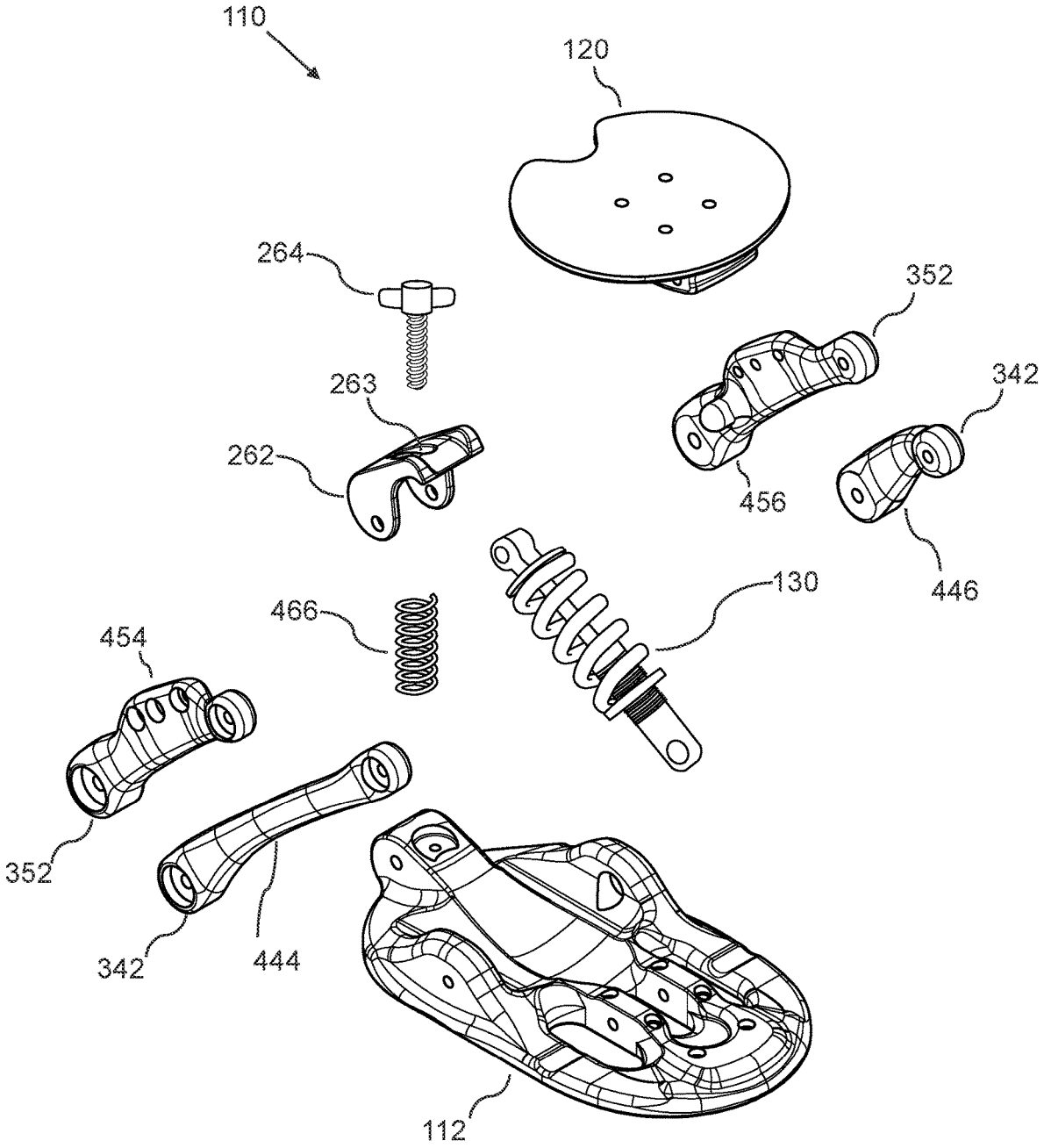
FIG. 4 is an exploded assembly view of the shock absorbing device, according to an embodiment of the invention.

In a further related embodiment, as shown in FIG. 4, the at least one front linkage arm 342 can include:

a) a right front linkage arm 444; and b) a left front linkage arm 446.

In a further related embodiment, as shown in FIG. 4, the at least one rear linkage arm 352 can include:

a) a right rear linkage arm 454; and b) a left rear linkage arm 456.

Figure 3A:
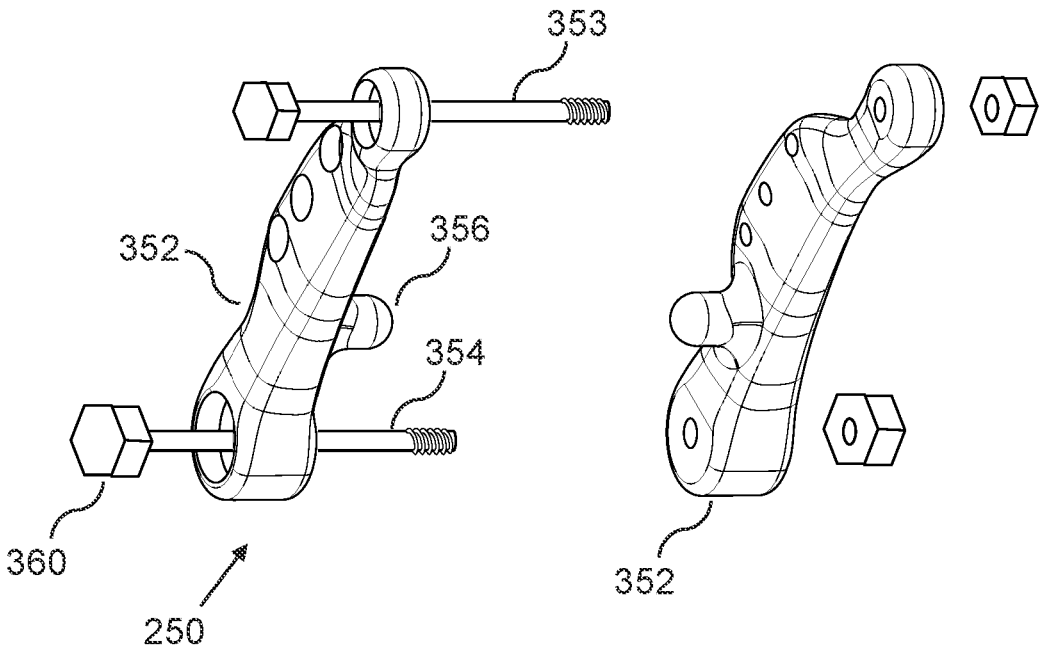
FIG. 3A is an exploded assembly view of the rear linkage arm assembly, according to an embodiment of the invention.
Figure 3B:
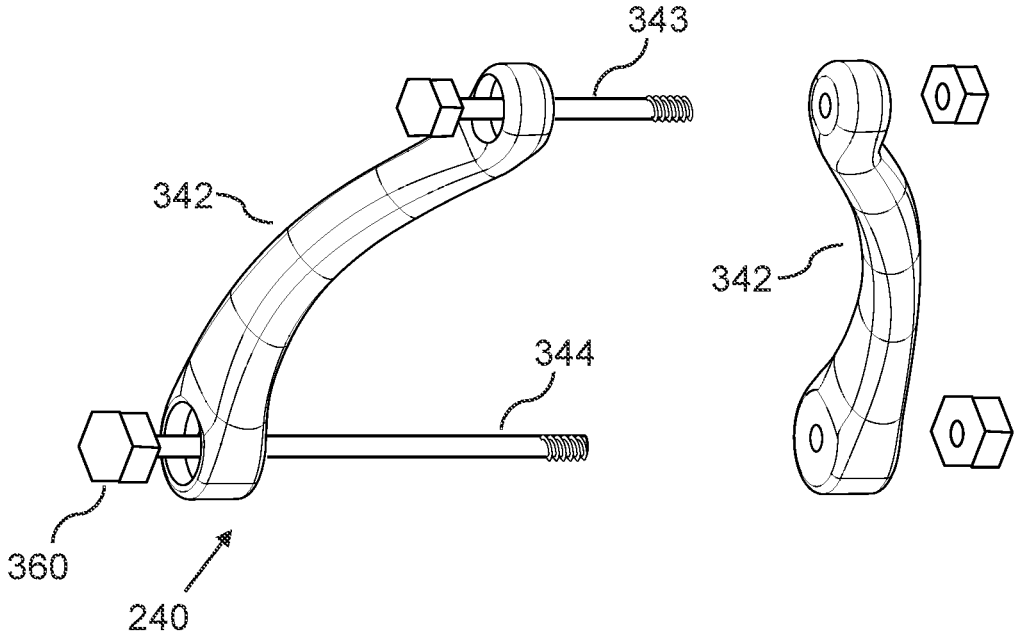
FIG. 3B is an exploded assembly view of the front linkage arm assembly, according to an embodiment of the invention.
Figure 5A:
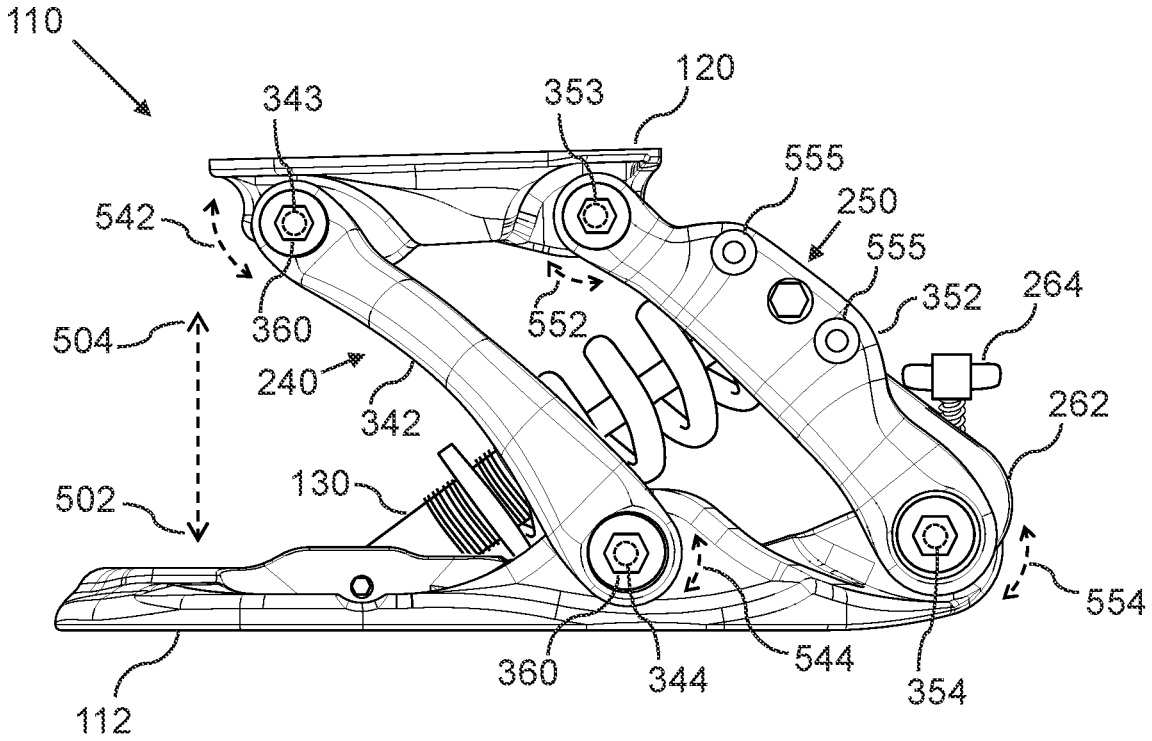
FIG. 5A is a right-side view of the shock absorbing device in an uncompressed state, according to an embodiment of the invention.
Figure 5B:
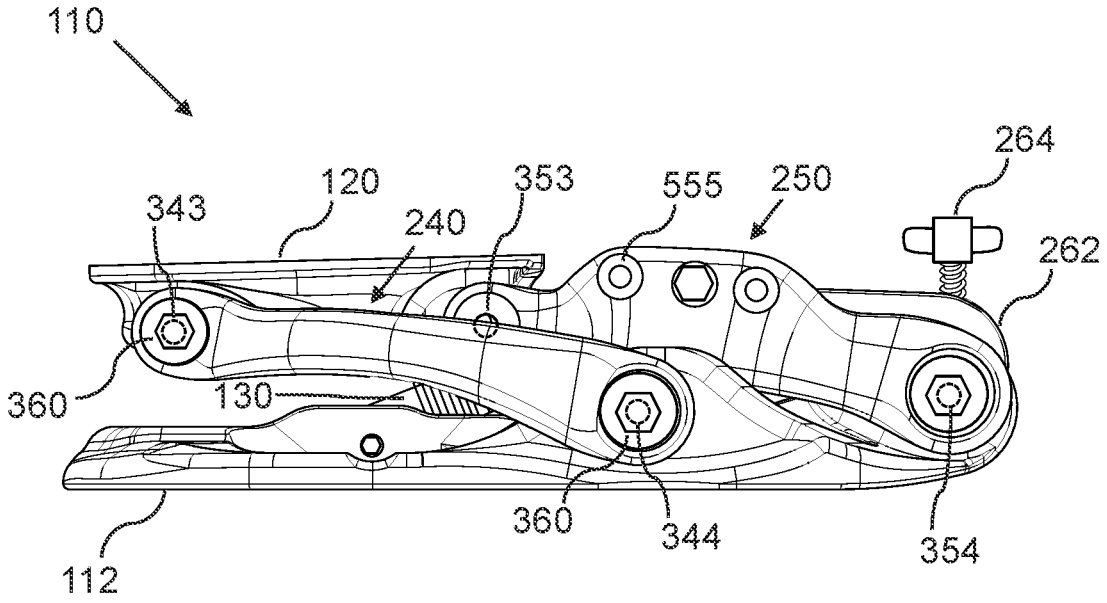
FIG. 5B is a right-side view of the shock absorbing device in a compressed state, according to an embodiment of the invention.

In a further related embodiment, as shown in FIGS. 3B, 5A and 5B, the front linkage arm assembly 240 can include:

a) a front upper axle 343, which can be configured to connect to the upper mounting structure 120, such that the upper end of the at least one front linkage arm 342 is rotatably 542 connected to the front upper axle 343 on a front end of the upper mounting structure 120;

b) a front lower axle 344, which can be configured to connect to the lower mounting structure 112, such that the lower end of the at least one front linkage arm 342 can be rotatably 544 connected to the front lower axle 344 on the lower mounting structure 112; and c) a plurality of nuts/bolt heads 360, which can be configured to attach to the front upper axle 343 and the front lower axle 344 on an outer end of the at least one front linkage arm 342, such that the plurality of nuts/bolt heads 360 can securely attach the at least one front linkage arm 342 to the upper mounting structure 120 and lower mounting structure 112;

such that the front linkage arm assembly 240 can be configured to rotate to allow for downward compression motion 502 of the upper mounting structure 120 towards the lower mounting structure 112 and upward decompression motion 504 of the upper mounting structure 120 away from the lower mounting structure 112.

In a further related embodiment, as shown in FIGS. 3A, 5A and 5B, the rear linkage arm assembly 250 can include:

a) a rear upper axle 353, which can be configured to connect to the upper mounting structure 120, such that the upper end of the at least one rear linkage arm 352 can be rotatably 552 connected to the rear upper axle 353, on a rear end of the upper mounting structure 120;

b) a rear lower axle 354, which can be configured to connect to the lower mounting structure 112, such that the lower end of the at least one rear linkage arm 352 can be rotatably 554 connected to the rear lower axle 354, on the lower mounting structure 112, to a rear of the front lower axle 344; and c) a plurality of nuts/bolt heads 360, which can be configured to attach to the rear upper axle 353 and the rear lower axle 354 on an outer end of the at least one rear linkage arm 352, such that the plurality of nuts/bolt heads 360 can securely attach the at least one rear linkage arm 352 to the upper mounting structure 120 and lower mounting structure 112;

such that the rear linkage arm assembly 250 can be configured to rotate to allow for downward compression motion of the upper mounting structure 120 towards the lower mounting structure 112 and upward decompression motion of the upper mounting structure 120 away from the lower mounting structure 112.

In a yet further related embodiment, as shown in FIGS. 5A and 5B, the rear linkage arm assembly 250 can further include:

a. at least one connection point 555, such that an upper end of the shock absorber 130 can be rotatably connected to the at least one connection point 555;

wherein a lower end of the shock absorber 130 can be rotatably connected to the lower mounting structure 112, such that the shock absorber 130 can compress when the upper mounting structure 120 moves downward and damps a downward motion of the rear linkage assembly 250.

In a related embodiment, as shown in FIGS. 5A and 5B, the at least one connection point 555 can be configured as a plurality of connection points 555, such that the shock absorber 130 can be configured to detachably connect to a selected connection point 555 in the plurality of connection points 555, such that a preload and/or damping of the shock absorber 130 can be adjusted (i.e. is adjustable) by connecting the shock absorber 130 to (a higher or a lower) selected connection point 555 in the plurality of connection points 555.

Figure 2B:
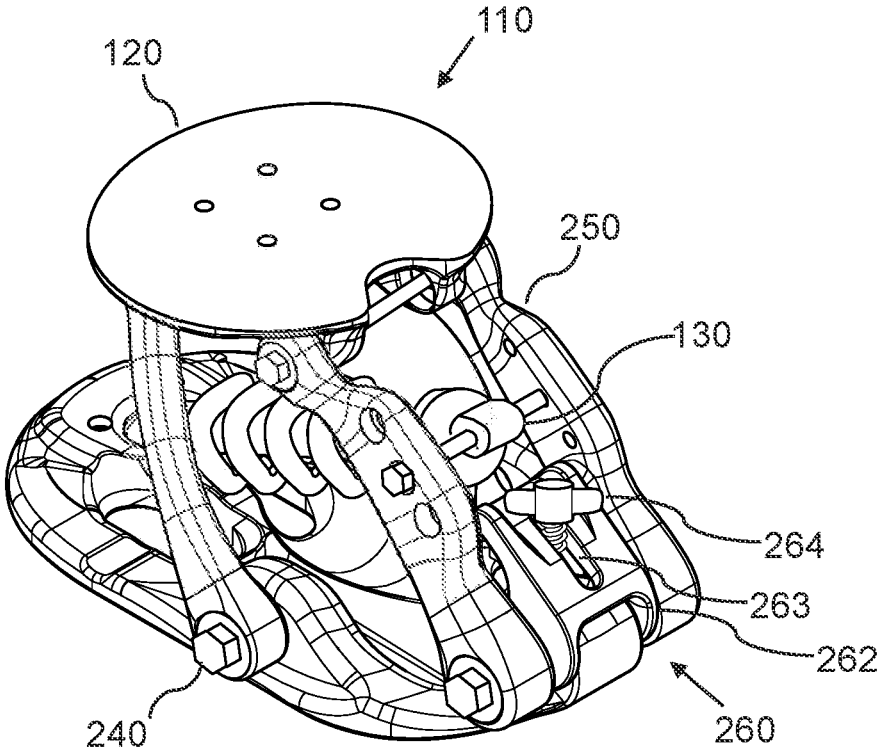
FIG. 2B is a rear perspective view of the shock absorbing device, according to an embodiment of the invention.
Figure 2C:
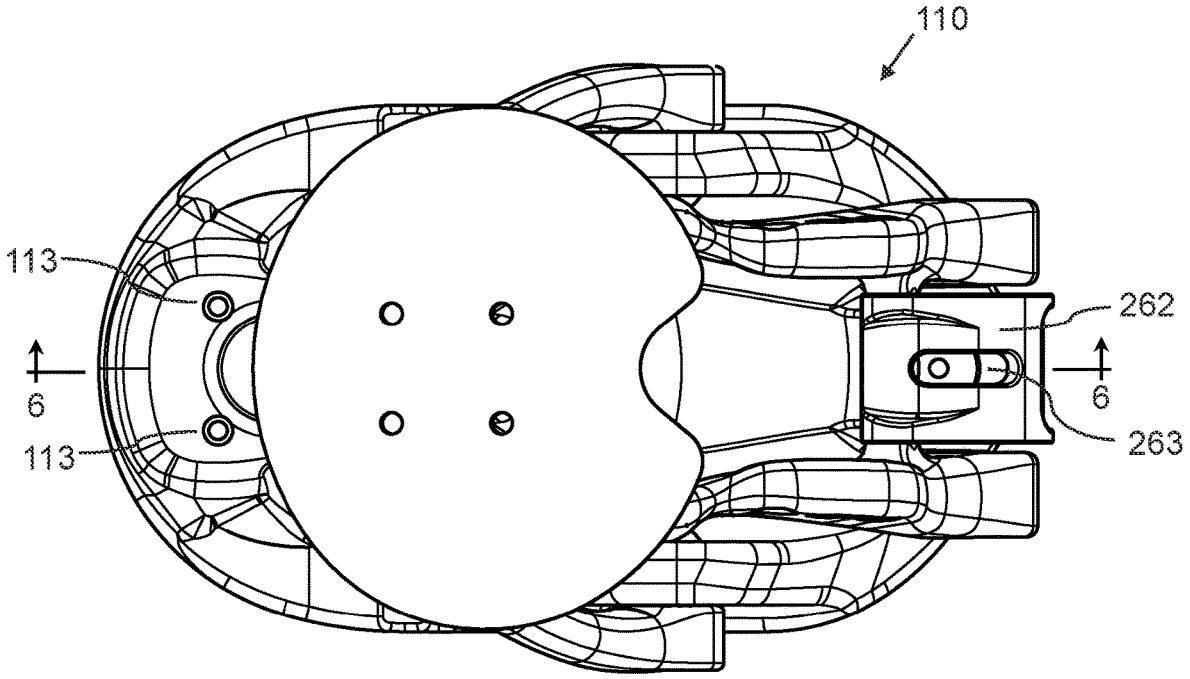
FIG. 2C is a top view of the shock absorbing device without a shock absorber mounted, according to an embodiment of the invention.
Figure 6:
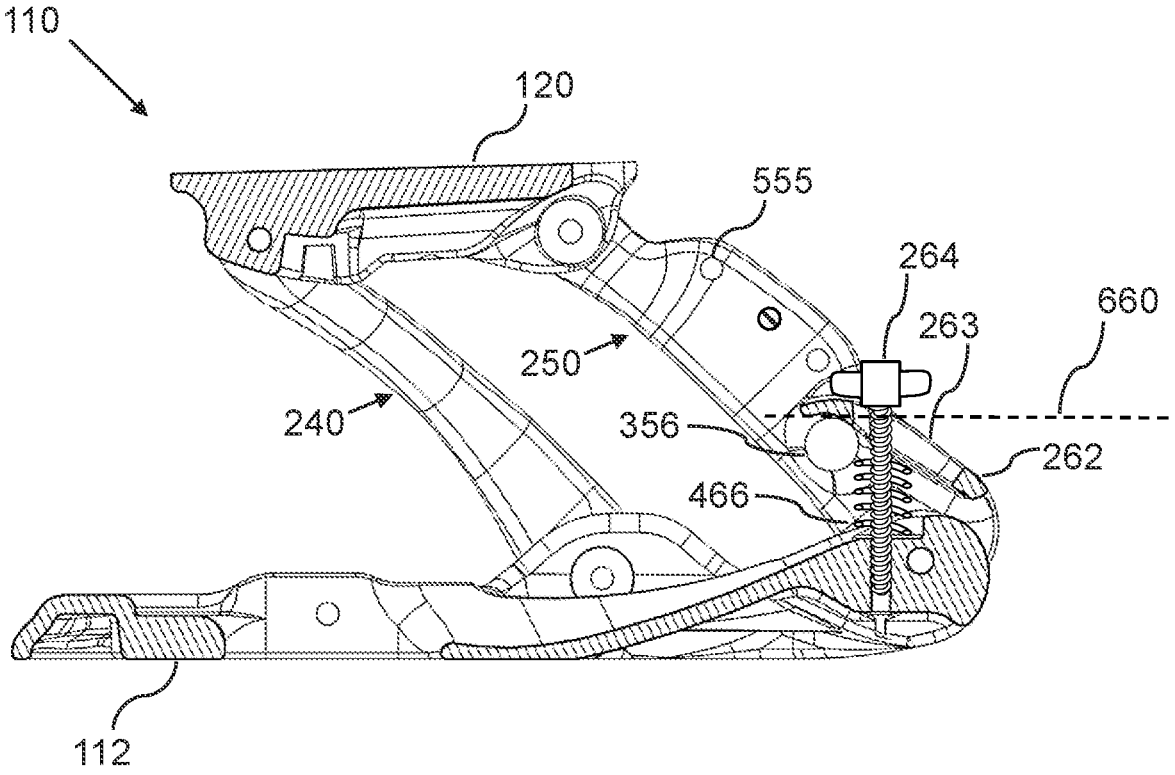
FIG. 6 is a right-side section view of the shock absorbing device in an uncompressed state, taking along section line 6-6 of FIG. 2C, according to an embodiment of the invention.

In another related embodiment, as shown in FIGS. 2B, 4 and 6, the shock absorbing device 110 can further include a safety assembly 260, which can be configured to stop the plurality of linkage arm assemblies 240, 250 from decompressing upwards 504 past a maximum height 660, for example when the shock absorbing device 110 decompresses when the snowboarder 180 becomes airborne during a jump, such that the safety assembly 260 can include:

a) a safety piece 262, which can rotatably connect to the lower mounting structure 112, wherein an upper portion of the safety piece 262 can include a protruding opening 263;

b) a spring 466, which can be placed underneath the safety piece 262 between the safety piece 262 and the lower mounting structure 112, such that the spring 466 holds the safety piece 262 up; and c) an adjustment screw 264, which can be inserted through the protruding opening 263 of the safety piece 262, such that the adjustment screw 264 can be inserted through the spring 466 and screwed into the lower mounting structure 112;

wherein a height of the adjustment screw 264 can determine a height of an upper end of the safety piece 262, such that the adjustment screw 264 can be screwed to adjust the height;

wherein the rear linkage arm assembly 250 can include an interior protrusion 356, such that the interior protrusion 356 can contact (i.e. contacts) the upper end of the safety piece 262, such that upward motion of the rear linkage assembly 250 can be stopped by the upper end of the safety piece 262;

whereby the height of the upper end of the safety piece can determine the maximum height 660 of the shock absorbing device 110.

Figure 7A:
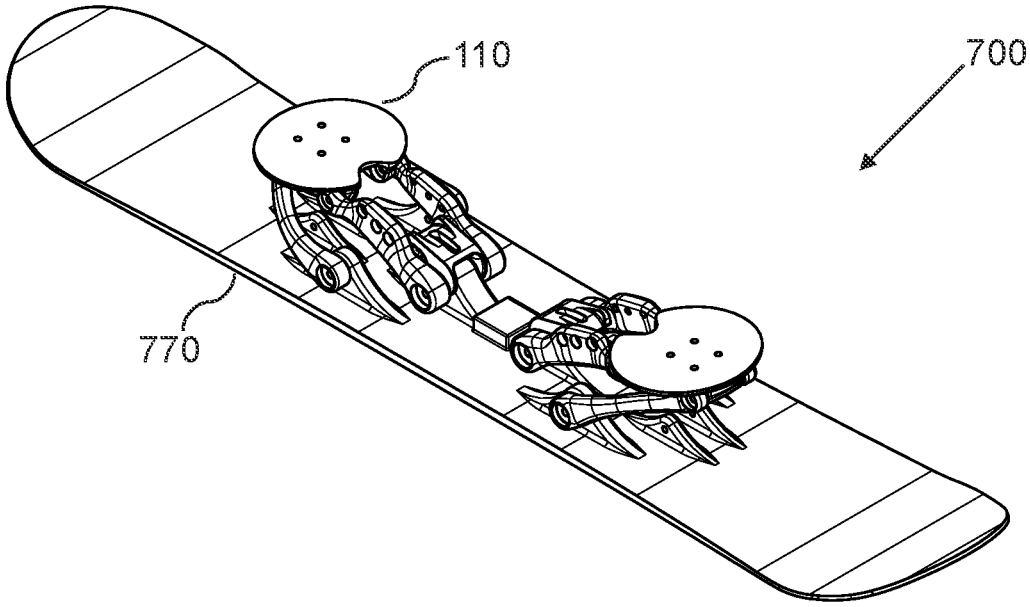
FIG. 7A is a perspective view of an alternative configuration of a snow sport shock absorbing system, according to an embodiment of the invention.
Figure 7B:
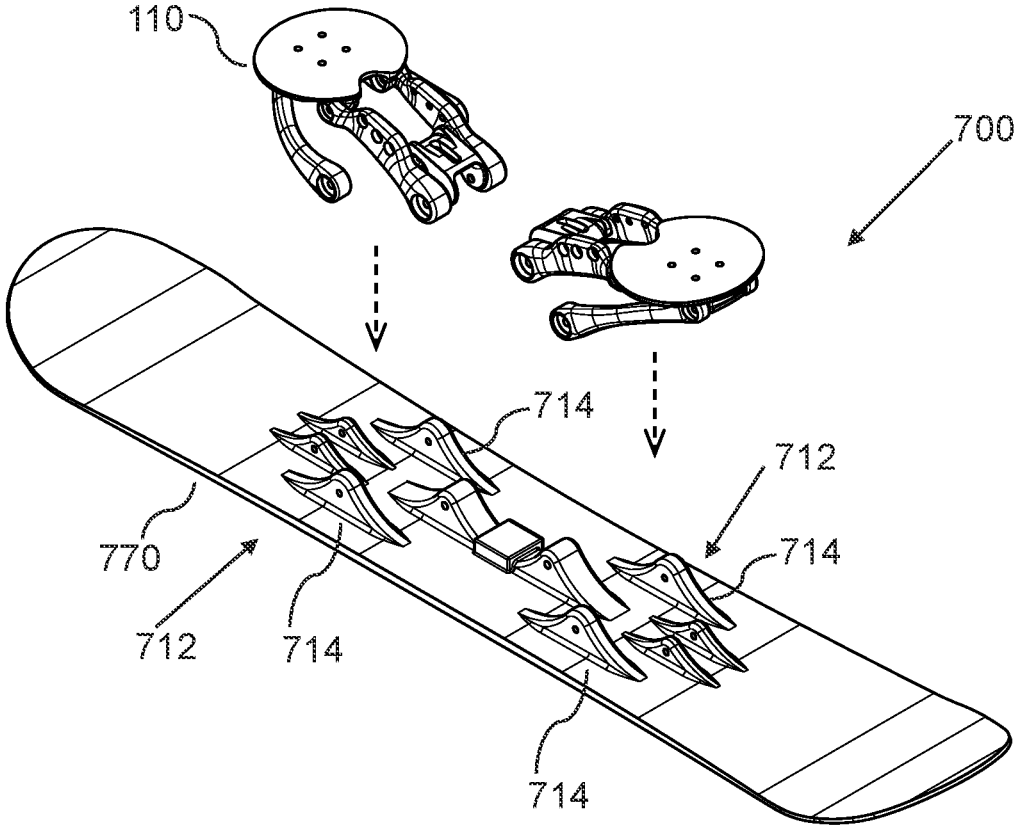
FIG. 7B is a perspective view illustrating the attachment of an alternative configuration of a shock absorbing device to an alternative configuration of a snow sport device, according to an embodiment of the invention.

In an alternative configuration, as shown in FIGS. 7A and 7B, the snow sport shock absorbing system 700 can be configured to include a customized snow sport device 770, such that the customized snow sport device 770 can be configured with mounting protrusions 714 that connect with lower ends of the linkage arm assemblies 240, 250 of the shock absorbing device 110, such that the lower mounting structure 112 is built into the customized snow sport device 770.

In another related embodiment, as shown in FIGS. 7A, 7B, 1A, 1B, 2A and 2B, an upper surface of the shock absorbing device 110 can include:

a) a lower mounting structure 712, which can include a plurality of mounting protrusions 714, which connect with lower ends of the linkage arm assemblies 240, 250 of the shock absorbing device 110; and the shock absorbing device 110 can include:

b) an upper mounting structure 120, which can be configured to compress downwards towards the lower mounting structure 112, such that the upper mounting structure 120 can be configured as a plate; and c) a shock absorber 130, which can be connected between the lower mounting structure 112 and the upper mounting structure 120, such that the shock absorber 130 can absorb and damp shock impulses from a ground surface 160 as the shock impulses travel from the lower mounting structure 112 to the upper mounting structure 120.

Thus, in an embodiment, a shock absorbing device can be configured to attach to a snow sport device; such that the shock absorbing device is configured to absorb shock impulses incurred from using the snow sport device with the shock absorbing device mounted for movement on a ground surface, whereby the shock absorbing device provides a user with a smooth ride on the ground surface.

Here has thus been described a multitude of embodiments of the snow sport shock absorbing system 100, and methods related thereto, which can be employed in numerous modes of usage.

The many features and advantages of the invention are apparent from the detailed specification, and thus, it is intended by the appended claims to cover all such features and advantages of the invention, which fall within the true spirit and scope of the invention.

Many such alternative configurations are readily apparent and should be considered fully included in this specification and the claims appended hereto. Accordingly, since numerous modifications and variations will readily occur to those skilled in the art, the invention is not limited to the exact construction and operation illustrated and described, and thus, all suitable modifications and equivalents may be resorted to, falling within the scope of the invention.

What is claimed is:

1. A snow sport shock absorbing system, comprising:

a) a snow sport device;

b) a shock absorbing device, which is connected to the snow sport device;

wherein the shock absorbing device comprises:

a lower mounting structure, which is connected to the snow sport device;

an upper mounting structure, which is configured to compress downwards towards the lower mounting structure; and a shock absorber, which is connected between the lower mounting structure and the upper mounting structure, such that the shock absorber absorbs and damps the shock impulses from the ground surface as the shock impulses travel from the lower mounting structure to the upper mounting structure; and c) a snow equipment piece;

wherein the snow sport device is a snowboard;

wherein the snow equipment piece is a snowboard binding;

wherein the snowboard binding is attached to the upper mounting structure; and wherein the shock absorbing device is configured to absorb shock impulses incurred from using the snow sport shock absorbing system for movement on a ground surface, whereby the snow sport shock absorbing system provides a user with a smooth ride on the ground surface;

d) further comprising: a plurality of linkage arm assemblies, which are configured to connect the upper mounting structure and the lower mounting structure, such that the upper mounting structure is compressible downwards towards the lower mounting structure;

e) wherein the plurality of linkage arm assemblies comprises:

a front linkage arm assembly, which comprises at least one front linkage arm, wherein an upper end of the at least one front linkage arm is rotatably connected to a front end of the upper mounting structure and a lower end of the at least one front linkage arm is rotatably connected to the lower mounting structure; and a rear linkage arm assembly, which comprises at least one rear linkage arm, wherein an upper end of the at least one rear linkage arm is rotatably connected to a rear end of the upper mounting structure and a lower end of the at least one rear linkage arm is rotatably connected to the lower mounting structure, to a rear of the lower end of the front linkage arm assembly; and f) wherein the rear linkage arm assembly further comprises:

at least one connection point, such that an upper end of the shock absorber is rotatably connected to the at least one connection point;

wherein a lower end of the shock absorber is rotatably connected to the lower mounting structure, such that the shock absorber compresses when the upper mounting structure moves downward and damps a downward motion of the rear linkage arm assembly.

2. The snow sport shock absorbing system of claim 1, wherein the snow sport device further comprises a set of attachment holes and wherein the lower mounting structure comprises attachment apertures, which are configured to align with the attachment holes of the snow sport device, such that a plurality of screws are insertable through the attachment apertures into the attachment holes, such that the plurality of screws attach the lower mounting structure to the snow sport device.

3. The snow sport shock absorbing system of claim 1, wherein the upper mounting structure comprises snow equipment piece attachment holes, which are configured to align with a set of snow equipment piece apertures on the snow equipment piece, such that a plurality of screws are insertable through the snow equipment piece apertures into the snow equipment piece attachment holes, such that the plurality of screws are configured to attach the snow equipment piece to the upper mounting structure.

4. The snow sport shock absorbing system of claim 1, wherein the front linkage arm assembly further comprises:

a) a front upper axle, which is configured to connect to the upper mounting structure, such that the upper end of the at least one front linkage arm is rotatably connected to the front upper axle; and b) a front lower axle, which is configured to connect to the lower mounting structure, such that the lower end of the at least one front linkage arm is rotatably connected to the front lower axle;

such that the front linkage arm assembly is configured to rotate to allow for downward compression motion of the upper mounting structure towards the lower mounting structure and upward decompression motion of the upper mounting structure away from the lower mounting structure.

5. The snow sport shock absorbing system of claim 1, wherein the rear linkage arm assembly further comprises:

a) a rear upper axle, which is configured to connect to the upper mounting structure, such that the upper end of the at least one rear linkage arm is rotatably connected to the rear upper axle; and b) a rear lower axle, which is configured to connect to the lower mounting structure, such that the lower end of the at least one rear linkage arm is rotatably connected to the rear lower axle;

such that the rear linkage arm assembly is configured to rotate to allow for downward compression motion of the upper mounting structure towards the lower mounting structure and upward decompression motion of the upper mounting structure away from the lower mounting structure.

6. The snow sport shock absorbing system of claim 1, wherein the at least one connection point is configured as a plurality of connection points, such that the shock absorber is configured to detachably connect to a selected connection point in the plurality of connection points, such that a preload and/or damping of the shock absorber is adjustable by connecting the shock absorber to the selected connection point in the plurality of connection points.

7. The snow sport shock absorbing system of claim 1, wherein the shock absorbing device further comprises:

a safety assembly, which is configured to stop the plurality of linkage arm assemblies from decompressing upwards past a maximum height.

8. The snow sport shock absorbing system of claim 7, wherein the safety assembly comprises:

a) a safety piece, which is rotatably connected to the lower mounting structure, wherein an upper portion of the safety piece comprises a protruding opening;

b) a spring, which is placed underneath the safety piece between the safety piece and the lower mounting structure, such that the spring holds the safety piece up; and c) an adjustment screw, which is insertable through the protruding opening of the safety piece, such that the adjustment screw is insertable through the spring and screwed into the lower mounting structure;

wherein a height of the adjustment screw determines a height of an upper end of the safety piece, such that the adjustment screw is screwed to adjust the height of the upper end;

wherein the rear linkage arm assembly comprises an interior protrusion, which contacts the upper end of the safety piece, such that upward motion of the rear linkage arm assembly is stopped by the upper end of the safety piece;

whereby the height of the upper end of the safety piece determines the maximum height of the shock absorbing device.

9. The snow sport shock absorbing system of claim 1, wherein an upper surface of the snow sport device comprises:

a lower mounting structure;

wherein the shock absorbing device comprises:

an upper mounting structure, which is configured to compress downwards towards the lower mounting structure; and a shock absorber, which is connected between the lower mounting structure and the upper mounting structure, such that the shock absorber absorbs and damps the shock impulses from the ground surface as the shock impulses travel from the lower mounting structure to the upper mounting structure.

10. A snow sport shock absorbing system, comprising:

a) a shock absorbing device, which is configured to attach to a snow sport device;

which is a snowboard, wherein the shock absorbing device comprises:

b) a lower mounting structure, which is configured to be connectable to the snow sport device;

c) an upper mounting structure, which is configured to compress downwards towards the lower mounting structure;

d) wherein the upper mounting structure is configured to receive a snowboard binding, such that the snowboard binding is attachable to the upper mounting structure; and e) a shock absorber, which is connected between the lower mounting structure and the upper mounting structure, such that the shock absorber absorbs and damps the shock impulses from the ground surface as the shock impulses travel from the lower mounting structure to the upper mounting structure;

f) wherein the shock absorbing device is configured to absorb shock impulses incurred from using the snow sport device with the shock absorbing device mounted for movement on a ground surface, whereby the shock absorbing device provides a user with a smooth ride on the ground surface;

g) further comprising: a plurality of linkage arm assemblies, which are configured to connect the upper mounting structure and the lower mounting structure, such that the upper mounting structure is compressible downwards towards the lower mounting structure;

h) wherein the plurality of linkage arm assemblies comprises:

a front linkage arm assembly, which comprises at least one front linkage arm, wherein an upper end of the at least one front linkage arm is rotatably connected to a front end of the upper mounting structure and a lower end of the front linkage arm assembly is rotatably connected to the lower mounting structure; and a rear linkage arm assembly, which comprises at least one rear linkage arm, wherein an upper end of the at least one rear linkage arm is rotatably connected to a rear end of the upper mounting structure and a lower end of the rear linkage arm assembly is rotatably connected to the lower mounting structure, to a rear of the lower end of the front linkage arm assembly; and i) wherein the rear linkage arm assembly further comprises:

at least one connection point, such that an upper end of the shock absorber is rotatably connected to the at least one connection point;

wherein a lower end of the shock absorber is rotatably connected to the lower mounting structure, such that the shock absorber compresses when the upper mounting structure moves downward and damps a downward motion of the rear linkage arm assembly.

11. The snow sport shock absorbing system of claim 10, wherein the shock absorbing device comprises:

a) a lower mounting structure, which is connected to the snow sport device;

b) an upper mounting structure, which is configured to compress downwards towards the lower mounting structure; and c) a shock absorber, which is connected between the lower mounting structure and the upper mounting structure, such that the shock absorber absorbs and damps the shock impulses from the ground surface as the shock impulses travel from the lower mounting structure to the upper mounting structure.

12. The snow sport shock absorbing system of claim 10, wherein the front linkage arm assembly further comprises:

a) a front upper axle, which is configured to connect to the upper mounting structure, such that the upper end of the at least one front linkage arm is rotatably connected to the front upper axle; and b) a front lower axle, which is configured to connect to the lower mounting structure, such that the lower end of the at least one front linkage arm is rotatably connected to the front lower axle;

such that the front linkage arm assembly is configured to rotate to allow for downward compression motion of the upper mounting structure towards the lower mounting structure and upward decompression motion of the upper mounting structure away from the lower mounting structure.

13. The snow sport shock absorbing system of claim 10, wherein the rear linkage arm assembly further comprises:

a) a rear upper axle, which is configured to connect to the upper mounting structure, such that the upper end of the at least one rear linkage arm is rotatably connected to the rear upper axle; and b) a rear lower axle, which is configured to connect to the lower mounting structure, such that the lower end of the at least one rear linkage arm is rotatably connected to the rear lower axle;

such that the rear linkage arm assembly is configured to rotate to allow for downward compression motion of the upper mounting structure towards the lower mounting structure and upward decompression motion of the upper mounting structure away from the lower mounting structure.

14. The snow sport shock absorbing system of claim 10, wherein the at least one connection point is configured as a plurality of connection points, such that the shock absorber is configured to detachably connect to a selected connection point in the plurality of connection points, such that a preload and/or damping of the shock absorber is adjustable by connecting the shock absorber to the selected connection point in the plurality of connection points.

15. The snow sport shock absorbing system of claim 10, wherein the shock absorbing device further comprises:

a safety assembly, which is configured to stop the plurality of linkage arm assemblies from decompressing upwards past a maximum height.

16. The snow sport shock absorbing system of claim 15, wherein the safety assembly comprises:

a) a safety piece, which is rotatably connected to the lower mounting structure, wherein an upper portion of the safety piece comprises a protruding opening;

b) a spring, which is placed underneath the safety piece between the safety piece and the lower mounting structure, such that the spring holds the safety piece up; and c) an adjustment screw, which is insertable through the protruding opening of the safety piece, such that the adjustment screw is insertable through the spring and screwed into the lower mounting structure;

wherein a height of the adjustment screw determines a height of an upper end of the safety piece, such that the adjustment screw is screwed to adjust the height of the upper end;

wherein the rear linkage arm assembly comprises an interior protrusion, which contacts the upper end of the safety piece, such that upward motion of the rear linkage arm assembly is stopped by the upper end of the safety piece;

whereby the height of the upper end of the safety piece determines the maximum height of the shock absorbing device.

17. A snow sport shock absorbing system, comprising:

a) a snow sport device; and b) a shock absorbing device, which is connected to the snow sport device;

wherein the shock absorbing device comprises:

c) a lower mounting structure, which is connected to the snow sport device;

d) an upper mounting structure, which is configured to compress downwards towards the lower mounting structure; and e) a shock absorber, which is connected between the lower mounting structure and the upper mounting structure, such that the shock absorber absorbs and damps the shock impulses from the ground surface as the shock impulses travel from the lower mounting structure to the upper mounting structure; and f) a snow equipment piece; wherein the snow sport device is a ski; wherein the snow equipment piece is a ski binding; wherein the ski binding is attached to the upper mounting structure; and g) the shock absorbing device is configured to absorb shock impulses incurred from using the snow sport shock absorbing system for movement on a ground surface, whereby the snow sport shock absorbing system provides a user with a smooth ride on the ground surface, h) further comprising: a plurality of linkage arm assemblies, which are configured to connect the upper mounting structure and the lower mounting structure, such that the upper mounting structure is compressible downwards towards the lower mounting structure;

i) wherein the plurality of linkage arm assemblies comprises:

a front linkage arm assembly, which comprises at least one front linkage arm, wherein an upper end of the at least one front linkage arm is rotatably connected to a front end of the upper mounting structure and a lower end of the at least one front linkage arm is rotatably connected to the lower mounting structure; and a rear linkage arm assembly, which comprises at least one rear linkage arm, wherein an upper end of the at least one rear linkage arm is rotatably connected to a rear end of the upper mounting structure and a lower end of the at least one rear linkage arm is rotatably connected to the lower mounting structure, to a rear of the lower end of the front linkage arm assembly;

j) wherein the rear linkage arm assembly further comprises:

at least one connection point, such that an upper end of the shock absorber is rotatably connected to the at least one connection point;

wherein a lower end of the shock absorber is rotatably connected to the lower mounting structure, such that the shock absorber compresses when the upper mounting structure moves downward and damps a downward motion of the rear linkage arm assembly.

* * * * *